United States Patent [19]

Nakamura

[11] 4,103,654

[45] Aug. 1, 1978

[54] METHOD AND APPARATUS TO CONTROL AIR/FUEL RATIO OF THE MIXTURE APPLIED TO AN INTERNAL COMBUSTION ENGINE

[75] Inventor: Koyo Nakamura, Yokosuka, Japan

[73] Assignee: Nissan Motor Company, Ltd., Japan

[21] Appl. No.: 627,860

[22] Filed: Oct. 31, 1975

[30] Foreign Application Priority Data

Nov. 1, 1974 [JP] Japan ..... 49-126241

[51] Int. Cl.[2] ..... F02B 73/10; F02H 3/00; F02M 37/00

[52] U.S. Cl. ..... 123/119 EC; 123/119 D; 123/124 R; 123/124 B

[58] Field of Search ..... 60/276, 285; 123/119 D, 123/119 DB, 124 R, 124 B

[56] References Cited

U.S. PATENT DOCUMENTS

| | | | |
|---|---|---|---|
| 3,698,371 | 10/1972 | Mitsuyama | 123/119 DB |
| 3,745,768 | 7/1973 | Zechnall | 60/285 |
| 3,759,232 | 9/1973 | Wahl | 123/119 DB |
| 3,782,347 | 1/1974 | Schmidt | 60/276 |
| 3,831,564 | 8/1974 | Schmidt | 60/285 |
| 3,866,588 | 2/1975 | Nakada | 123/124 B |
| 3,911,884 | 10/1975 | Moriya | 60/276 |
| 3,931,710 | 1/1976 | Hartel | 60/276 |
| 3,949,551 | 4/1976 | Eichler | 60/276 |
| 3,958,544 | 5/1976 | Shinoda | 123/119 DB |
| 3,963,009 | 6/1976 | Mennesson | 60/276 |

*Primary Examiner*—Wendell E. Burns

[57] ABSTRACT

Addition air is admitted into a fuel passage of a carburetor through an open electromagnetic valve which is electronically controlled between the open and closed position in accordance with an oxygen sensor signal indicating the oxygen concentration in the engine exhaust gases. The amount of the additional air being supplied to the fuel passage is reduced at the rate proportional to the vacuum created by operation of the engine in a venturi section, choke section and/or intake manifold.

6 Claims, 5 Drawing Figures

METHOD AND APPARATUS TO CONTROL AIR/FUEL RATIO OF THE MIXTURE APPLIED TO AN INTERNAL COMBUSTION ENGINE

The present invention relates to a method and an apparatus to control the ratio of air to fuel of the air-fuel mixture being applied to internal combustion engine and more particularly to such method and apparatus in which, besides the air supplied through an air bleed, additional air is admitted into a fuel passage of a carburetor in accordance with a sensed oxygen content in the exhaust gases from the internal combustion engine to thereby control the rate of fuel inducted through the fuel passage into the carburetor.

The exhaust content, most appropriately the concentration of oxygen in the exhaust gases that is closely related to the existent air-fuel ratio of the mixture is measured by means of an oxygen sensing device. Such an oxygen sensing device may be formed of a solid electrolyte, preferably zirconium dioxide, which is conductive for oxygen ions. The output signal of the oxygen sensor then is applied to an electronic control system to determine the opening and closing position of electromagnetic valves which control additional air being supplied to a fuel passage of a carburetor. If insufficient oxygen is present in the exhaust gases, indicating that the mixture is too rich, additional air is supplied to the fuel passage through the open electromagnetic valve to provide a somewhat leaner air-fuel mixture to the engine and vice versa.

The air/fuel ratio obtained during opening of the electromagnetic valve and accordingly that during closure of the valve are determined to be substantially constant throughout the varying engine conditions so that the medium between said two fixed values approximates a predetermined value for example a stoichiometric air/fuel ratio as closely as possible.

In conventional methods and apparatuses of the type described, however, the volume of additional air passing through the open electromagnetic valve will be more than required to form a stoichiometric mixture, providing too lean mixture, when an extremely high vacuum is developed in the carburetor as in acceleration or deceleration.

It is therefore an object of the present invention to improve the control of the ratio of air to fuel of the air/fuel mixture being applied to the engine to the substantially fixed, stoichiometric value and more particularly to limit the volume of additional air being admitted into the fuel passage at a the rate proportional to the vacuum developed in a portion of the engine by operation thereof.

Another object is to provide one or more additional air bleed passages in addition to usual air bleeds to a fuel passage of the carburetor, wherein the additional air passages communicates with a choke section or a venturi section of the carburetor or the intake manifold to conduct part of additional air into any one of them at the rate proportional to the vacuum created therein.

Other objects, features and advantages of the present invention will be more apparent from the following detailed description.

The invention will be described by way of example with reference to the accompanying drawings, in which.

Figure 1:
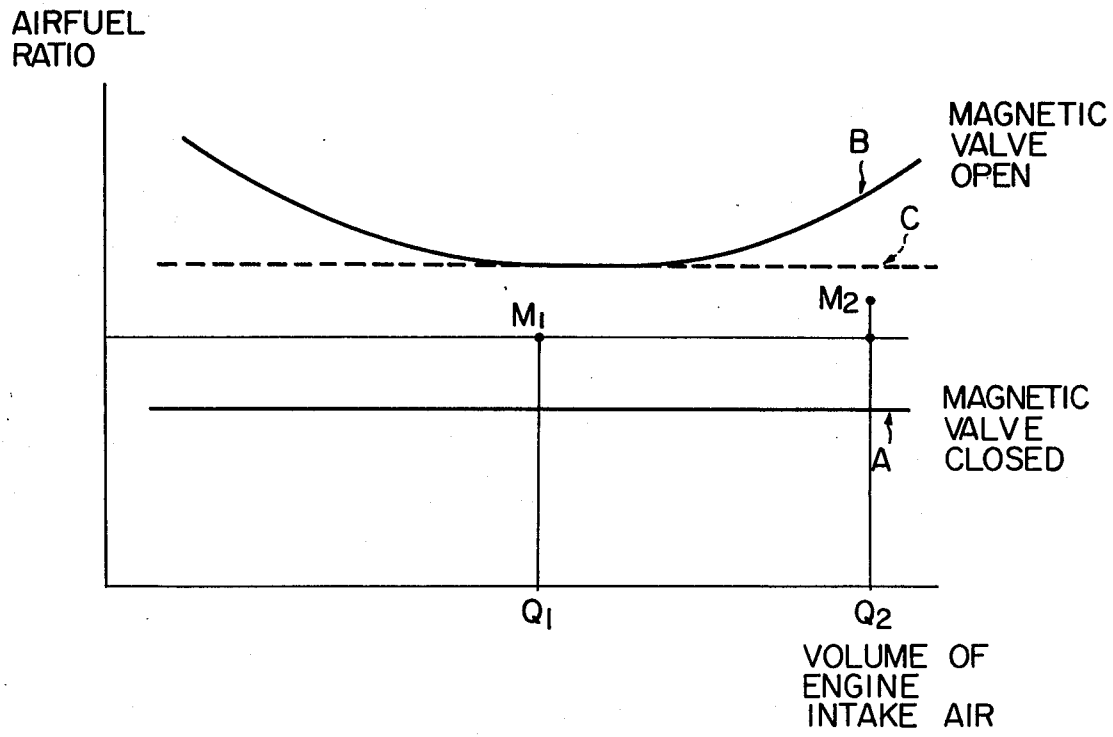
FIG. 1 is a graph illustrating the relationship betweem the air/fuel ratio and the volume of engine intake air, respectively during opening of the electromagnetic valve and during closure thereof.

With reference to FIG. 1, if the air/fuel ratio of the mixture obtained during full closure of the electromagnetic valve is maintained at the fixed value indicated by the line A, irrespective of the varying volume of the engine intake air, the ideal or desired air/fuel ratio during opening of the electromagnetic valve should be that indicated by the broken line C which is substantially parallel to the line A. However, in actual practice, the air/fuel ratio during opening of the valve deviates from the line C as indicated by the solid line B, to the leaner side as the engine intake air is increased or decreased. This is because, as has been briefly mentioned, an excessive amount of additional air is conducted into the fuel passage of a carburetor by the action of a high vacuum developed in the venturi portion during acceleration or in the intake manifold during deceleration. In general, too wide a distance between the lines A and B is undesirable in any engine condition because it causes unstable engine operation.

Let it be assumed, by way of example, that the engine intake air is $Q_1$ on the graph and the desired value of the air/fuel ratio, i.e. the medium point between the lines A and C is $M_1$. If the engine is subject to abrupt acceleration, the engine intake air increases to $Q_2$, the venturi vacuum rising abruptly. As therefore the volume of additional air is increased, the air/fuel ratio actually obtained is $M_2$ which is the medium point between the lines A and B. The air/fuel mixture is likewise diluted during deceleration.

The present invention proposes a method to maintain the air/fuel ratios during opening and closure of the electromagnetic valve to be substantially parallel to one another at an appropriate distance, therefore to approximate the curve B to the ideal characteristics indicated by the line C if the value A is fixed. Briefly, the method comprises the step of limiting the volume of additional being supplied to a carburetor fuel passage at the rate proportional to the vacuum created in the choke section, venturi section or intake manifold.

Figure 2:
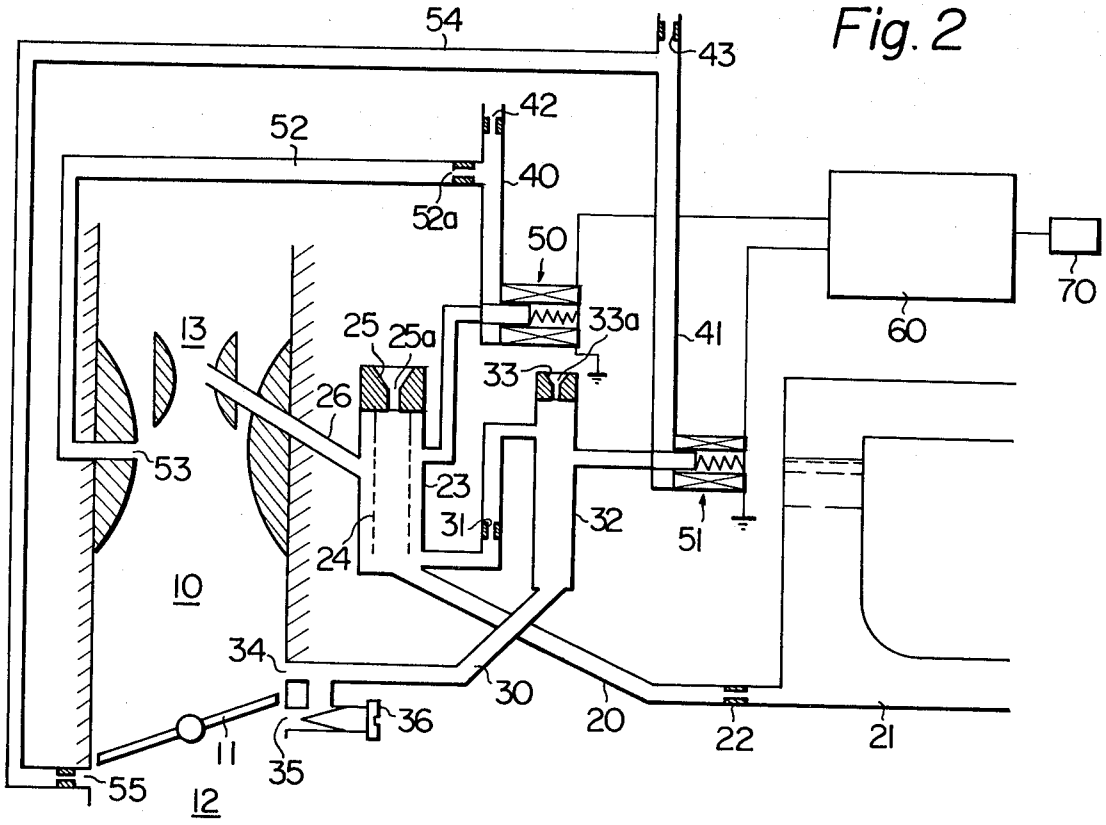
FIG. 2 is a schematic representation of the control apparatus in accordance with a preferred embodiment of the present invention.

FIG. 2 highly schematically illustrates a preferred embodiment of an apparatus incorporating the subject matter of the present invention, in which the internal combustion engine (not entirely shown) comprises an air intake passage 10, a throttle valve 11 movably located within passage 10, and an intake manifold 12 integral with the intake passage through the throttle valve. An exhaust pipe 16 (FIG. 3) forms part of the engine. The air intake passage has a venturi section 13 of a double venturi type and a choke section 14 (FIG. 4) upstream of the venturi section in which a choke valve 15 is accommodated.

The carburetor as is well known consists of a main fuel passage 20 including a main fuel jet 22, a main well 23 enclosing an emulsion tube 24, a main air bleed passage 25 with a main air bleed jet **25*a* provided to the emulsion tube and a main nozzle 26, and a slow fuel passage 30 including a slow jet 31, a slow well 32, a slow air bleed passage 33 with a slow air bleed jet 33***a* provided to the slow well and a slow and idle ports 34 and 35 with idle adjust screw 36. The fuel from a fuel source or float chamber 21 is mixed with the air passed through the main or slow air bleed 25, 33, the fuel thus emulsified being induced into the venturi section 13 or the intake manifold 12, in whichever a higher vacuum prevails.

Besides the air passed through the air bleed, additional air is admitted into the main well 23 through an additional air bleed passage 40 opening to the atmosphere directly or through an air filter. Likewise, an additional air bleed passage 41 for slow and idle engine condition is connected between the atmosphere and a slow well 32. Both the additional air bleed passages are provided with metering orifices 42, 43 of appropriately selected diameters.

Electromagnetic valves 50, 51 are located respectively in the additional air bleed passages 40, 41 and alternately movable between the open and closed position to control additional air flow. Movements of the valves 50, 51 are controlled in accordance with the output signal from an electric control 60, whose input is connected to an oxygen sensor 70 located in the exhaust pipe 16 for contact with the exhaust gases (see FIG. 3). The oxygen sensor measures the oxygen concentration in the exhaust gases from the engine that is related to the air/fuel ratio of the mixture supplied to the engine and produces an electric command signal indicative of the measured oxygen concentration.

Figure 3:
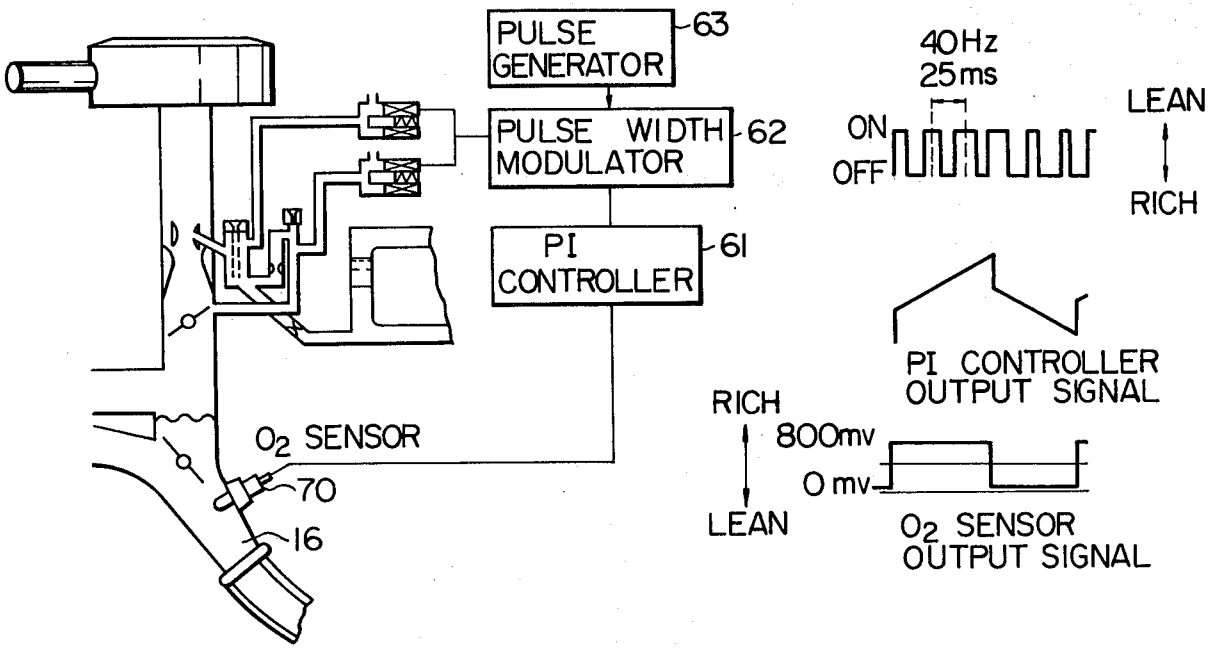
FIG. 3 is a schematic, diagrammatic view of a control loop of the apparatus shown in FIG. 2.

An example of an electronic control loop is schematically diagrammatically shown in FIG. 3. The control loop, including the oxygen sensor 70, is a socalled closed loop. When the oxygen sensor 70 provides a command signal shown which indicates a deviation from a substantially fixed, desired threshold value of the air/fuel ratio which may be stoichiometric, that signal is applied to the input of a proportional-integral controller 61 at the output of which a appears a signal as illustrated. A circuit including a pulse width modulator 62 and a pulse generator 63 produces a series of pulse signals to be applied to the electromagnetic valve, the widths of which are varied in accordance with the level of the input signals from the proportionalintegral controller. Thus, for instance, if the sensor signal indicates the air-fuel ratio being deviated from the desired value to the richer side, the duty factor of the pulse signals is increased to allow an increased volume of additional air through the open valve. In reverse, it is apparent that the volume of additional air is limited as the duty factor of the signals is reduced. It follows that theoretically the ideal value of air/fuel ratio indicated by the line C in FIG. 1 has to be obtained during opening of the electromagnetic valve.

As has been already described, the actually obtainable air/fuel ratio during opening of the electromagnetic valve is that indicated by the curve B. In order that the actual value should be as close as possible to the desired line C, the present invention proposes: A conduit 52 having a metering orifice 52*a* is branched off from the additional air bleed passage 40 for main fuel passage upstream of the electromagnetic valve 50 and opens at 53 to the venturi section of the air intake passage. Another conduit 54 having a metering orifice 54*a* is likewise branched off from the additional air bleed passage 41 and opens at 55 to the intake manifold 12 immediately below the closed throttle valve. As a result, if a high vacuum prevails in the venturi section or in the intake manifold in dependence on the engine speed or load and therefore on the varying volume of engine intake air, a part of the additional air in the passage 40 or 41 is conducted directly into the venturi section or the intake manifold without being mixed with the air-fuel mixture in the main well 23 or slow well 32. Excessive dilution of the mixture is therefore prevented and substantially desired air/fuel ratio along the line C can be obtained.

Figure 4:
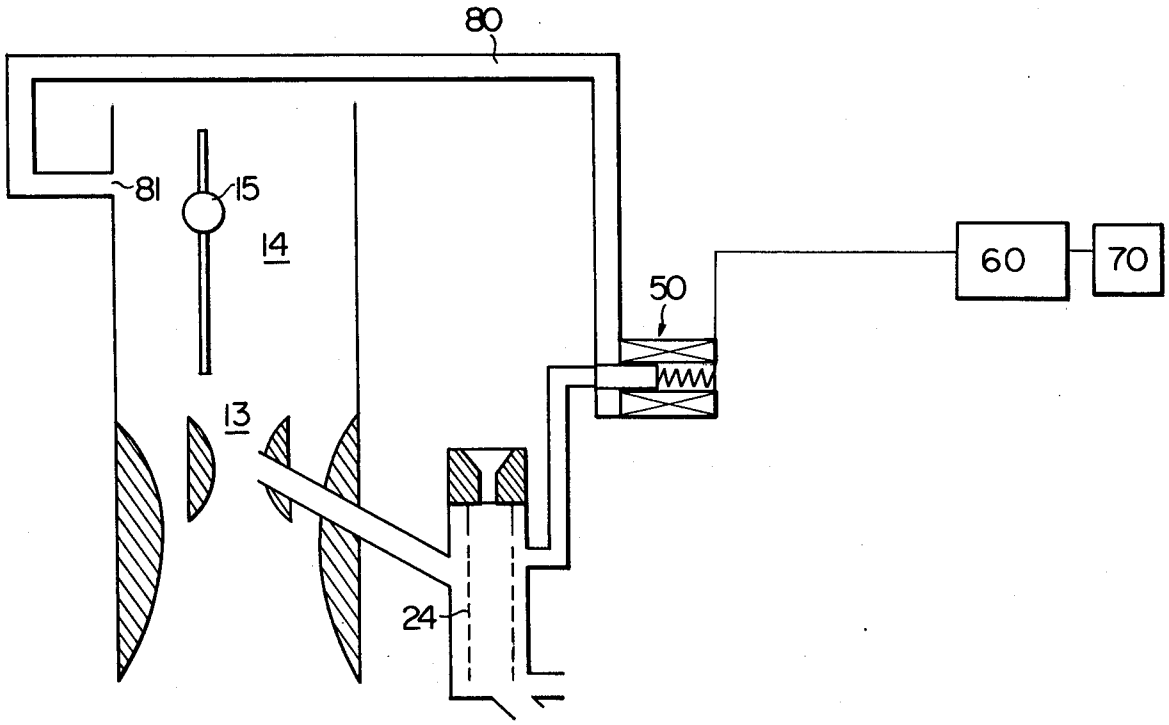
FIG. 4 is a partial view similar to FIG. 2 illustrating another preferred embodiment of the present invention.

FIG. 4 shows another preferred embodiment incorporating the method according to the present invention. As shown, an additional air bleed passage 80, instead of freely opening to the atmosphere, opens at 81 to the choke section 14 of the air intake passage. As long as the throttle valve is at a relatively narrow position, therefore the volume of engine intake air is limited, the velocity of intake air flow through the choke section is relatively low so that the air pressure is substantially equal to or slightly lower than the atmospheric prevails in the choke chamber. Accordingly, additional air from the choke section is admitted into the main well 23 through the additional air bleed passage 80 with the open electromagnetic valve 50, by the action of the differential pressure between the main well 23 in which the venturi vacuum prevails and the choke section 14. As the volume of intake air is increased with the throttle valve moving to a wide open position, a high vacuum developed in the venturi section influences the choke section so that a substantial vacuum prevails in the choke section. Thus, only a limited volume of additional air is allowed from the choke chamber through the open electromagnetic valve into the main well. This preferred embodiment is advantageous in a sense that filtered intake air rather than unclean atmospheric air is used as the additional air, without the provision of an air filter exclusively for the additional air bleed passages being required.

Figure 5:
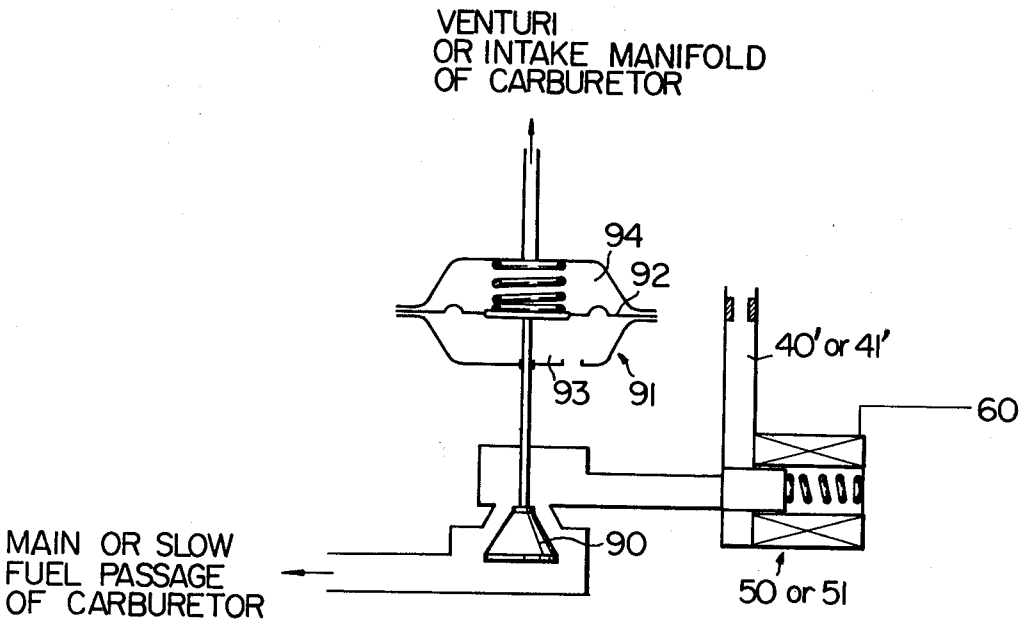
FIG. 5 is a view schematically showing part of the control apparatus according to a further preferred embodiment of the present invention.

FIG. 5 illustrates another preferred embodiment of the present invention. This preferred embodiment is different from the embodiment shown in FIG. 2 in that, instead of allowing part of additional air into the venturi section or the intake manifold according to the vacuum therein, the volume of air through additional air bleed passage 40' or 41' is controlled by a diaphragm-actuated valve 90 which is located in the passage 40' or 41' just downstream of the electromagnetic valve 50 or 51. The valve 90 is fixed to the diaphragm 92 of a diaphragm actuator 91 as known per se, the lower chamber 93 of which opens to the atmosphere, while the upper chamber 94 communicates with a venturi section or intake manifold. Thus, as the venturi vacuum or manifold vacuum is increased, the degree of opening of the valve 90 is decreased and accordingly the additional air volume through the open electromagnetic valve is limited at the valve 90 in full response to the degree of vacuum created in the venturi section or intake manifold, and vice versa. Since the effective open area of the additional air passage is variable by this valve 90, more precise control of the additional air volume is possible according to this embodiment.

The invention is not intended to be limited to the details shown and various modifications and structural changes may be made without departing from the inventive concept. For instance, a sensed oxygen signal used in the described embodiments as a typical and most appropriate engine operating variable, may be replaced by any one of such variables as hydrocarbon, carbon monoxide, carbon dioxide or nitrogen oxide representing signals.

What is claimed is:

1. In an internal combustion engine including an intake passage, an exhaust passage and a carburetor forming part of the engine intake passage and having a fuel delivery passage fluidly connected between the engine intake passage and a source of fuel supply and a calibrated fuel jet located in said fuel delivery passage, an apparatus to control the ratio of air to fuel of the air/fuel mixture being delivered to the engine, comprising means sensing the concentration of a gas component of the exhaust gases through the exhaust passage which is related to the ratio of air to fuel of the air/fuel mixture and generating an electric output signal indicative of the sensed concentration of the gas component, additional air passage means fluidly connected between the atmosphere and said fuel delivery passage at a portion downstream of said fuel jet, electromagnetic means actuable in accordance with said output signal for controlling the rate of air passing through said additional air passage means, and means for limiting the flow rate of the additional air through said additional air passage means in accordance with the vacuum being created by operation of the engine in a portion of the engine intake passage.

2. In an internal combustion engine including an intake passage, an exhaust passage and a carburetor forming part of the engine intake passage and having a fuel delivery passage fluidly connected between the engine intake pasage and a source of fuel supply, and a calibrated fuel jet located in said fuel delivery passage, said fuel delivery passage having air bleed means opening to the atmosphere at a portion downstream of said fuel jet, an apparatus to control the ratio of air to fuel of the air/fuel mixture being delivered to the engine comprising, means sensing the concentration of a gas component of the exhaust gases through the exhaust passage which is related to the ratio of air to fuel of the air/fuel mixture and generating an electric output signal indicative of the sensed concentration of the gas component, additional air passage means fluidly connected between the atmosphere and said fuel delivery passage at a portion downstream of said air bleed means, electromagnetic means actuable in accordance with said output signal for controlling the rate of air passing through said additional air passage means, and means for limiting the flow rate of additional air through said additional air passage means in accordance with the vacuum being created by operation of the engine in a portion of the engine intake passage.

3. In an internal combustion engine including an intake passage, an exhaust passage and a carburetor forming part of the engine passage and having a main fuel delivery passage fluidly connected between a source of fuel supply and the engine intake passage, a slow fuel delivery passage derived from and located downstream of the main fuel delivery passage and a calibrated fuel jet located in the main fuel delivery passage, an apparatus to control the ratio of air to fuel of the air/fuel mixture being delivered to the engine comprising, means sensing the concentration of a gas component of the exhaust gases through the exhaust passage which is related to the ratio of air to fuel of the air/fuel mixture and generating an electric output signal indicative of the sensed concentration of the gas component, a first additional air passageway fluidly connected between the atmosphere and said main fuel delivery passage at a portion downstream of said fuel jet, a second additional air passageway fluidly connected between the atmosphere and said slow fuel delivery passage, a first electromagnetic valve provided in said first additional air passageway and actuable in accordance with said output signal for controlling the rate of air passing through said first passageway, a second electromagnetic valve provided in said second additional air passageway and actuable in accordance with said output signal for controlling the rate of air passing through said second passageway, first means for limiting the flow rate of air through said first air passageway in accordance with the vacuum being created by operation of the engine in the engine intake passage, and second means for limiting the flow rate of air through said second air passageway in accordance with the vacuum being created by operation of the engine in the engine intake passage.

4. In an internal combustion engine including an intake passage, an exhaust passage and a carburetor forming part of the engine intake passage and having a venturi section, a throttle valve, a main fuel delivery passage fluidly connected between a source of fuel supply and the venturi section of the intake passage, a slow fuel delivery passage located downstream of the main fuel delivery passage and opening to the intake passage near the closed throttle valve and a calibrated fuel jet located in the main fuel delivery passage, an apparatus to control the ratio of air to fuel of the air/fuel mixture being delivered to the engine comprising means sensing the concentration of a gas component of the exhaust gases through the exhaust passage which is related to the ratio of air to fuel of the air/fuel mixture and generating an electric output signal indicative of the sensed concentration of the gas component, a first additional air passageway fluidly connected between the atmosphere and the main fuel delivery passage at a portion downstream of the fuel jet, a second additional air passageway fluidly connected between the atmosphere and said slow fuel delivery passage, a first electromagnetic valve provided in said first passageway and actuable in accordannce with said output signal for controlling the rate of air passing through said first passageway, a second electromagnetic valve provided in said second passageway and actuable in accordance with said output signal for controlling the rate of air passing through the second passageway, a first conduit fluidly connected between said first additional air passageway at the upstream portion of said first electromagnetic valve and the venturi section of the engine intake passage, and a second conduit fluidly connected between said second additional air passageway at the upstream portion of said second electromagnetic valve and the portion downstream of the throttle valve in the engine intake passage.

5. In an internal combustion engine including an intake passage, an exhaust passage and a carburetor forming part of the engine intake passage and having a choke section, a venturi section, a throttle valve, a main fuel delivery passage fluidly connected between a source of fuel supply and the venturi section of the intake passage, a slow fuel delivery passage located downstream of the main fuel delivery passage and opening to the intake passage near the closed throttle valve and a calibrated fuel jet located in the main fuel delivery passage, an apparatus to control the ratio of air to fuel of the air/fuel mixture being delivered to the engine, comprising means sensing the concentration of a gas component of the exhaust gases through the exhaust passage which is related to the ratio of air to fuel of the air/fuel mixture and generating an electric output signal indicative of the sensed concentration of the gas component, a first additional air passageway fluidly connected between the atmosphere and the main fuel delivery passage at a portion downstream of the fuel jet, a second additional air passageway fluidly connected between the atmosphere and said slow fuel delivery passage, a first electromagnetic valve provided in said first passageway and actuable in accordance with said output signal for controlling the rate of air passing through said first passageway, a second electromagnetic valve provided in said second passageway and actuable in accordance with said output signal for controlling the rate of air passing through the second passageway, a first conduit fluidly connected between said first additional air passageway at the upstream portion of said first electromagnetic valve and the choke section of the engine intake passage, and a second conduit fluidly connected between said second additional air passageway at the upstream portion of said second electromagnetic valve and the portion downstream of the throttle valve in the engine intake passage.

6. In an internal combustion engine including an intake passage, an exhaust passage and a carburetor forming part of the engine intake passage and having a venturi section, a throttle valve, a main fuel delivery passage fluidly connected between a source of fuel supply and the venturi section of the intake passage, a slow fuel delivery passage located downstream of the main fuel delivery passage and opening to the intake passage near the closed throttle valve and a calibrated fuel jet located in the main fuel delivery passage, an apparatus to control the ratio of air to fuel of the air/fuel mixture being delivered to the engine, comprising means sensing the concentration of a gas component of the exhaust gases through the exhaust passage which is related to the ratio of air to fuel of the air/fuel mixture and generating an electric output signal indicative of the sensed concentration of the gas component, a first additional air passageway fluidly connected between the atmosphere and the main fuel delivery passage at a portion downstream of the fuel jet, a second additional air passageway fluidly connected between the atmosphere and said slow fuel delivery passage, a first electromagnetic valve provided in said first passageway and actuable in accordance with said output signal for controlling the rate of air passing through said first passageway, a second electromagnetic valve provided in said second passageway and actuable in accordance with said output signal for controlling the rate of air passing through the second passageway, a first valve disposed in said first additional air passageway downstream of the first electromagnetic valve, a first diaphragm-operable valve actuator operable by a pressure difference across a diaphragm, said actuator having a vacuum chamber communicating with the venturi section of the engine intake passage, a second valve disposed in said second additional air passageway downstream of the second electromagnetic valve, and a second diaphragm-operable valve actuator operable by a pressure difference across a diaphragm, said actuator having a vacuum chamber communicating with the engine intake passage downstream of the intake passage.

* * * * *